US006347971B1

(12) United States Patent
Berke et al.

(10) Patent No.: US 6,347,971 B1
(45) Date of Patent: Feb. 19, 2002

(54) SWIMMER'S TRAINING DEVICE

(75) Inventors: Joseph J. Berke, 3248 Interlaken, West Bloomfield, MI (US) 48323; Charles T. Michael, Troy, MI (US)

(73) Assignee: Joseph J. Berke, West Bloomfield, MI (US)

( * ) Notice: Subject to any disclaimer, the term of this patent is extended or adjusted under 35 U.S.C. 154(b) by 0 days.

(21) Appl. No.: 09/826,777

(22) Filed: Apr. 6, 2001

(51) Int. Cl.[7] ..... B23C 9/08
(52) U.S. Cl. ..... 441/129; 434/254; 441/43
(58) Field of Search ..... 434/254; 441/35, 441/44, 43, 129–132, 136

(56) References Cited

U.S. PATENT DOCUMENTS 6,126,504 A * 10/2000 Day ..... 441/131

* cited by examiner

*Primary Examiner*—Ed Swinehart
(74) *Attorney, Agent, or Firm*—Alex Rhodes

(57) ABSTRACT

A device and method for training a young child how to swim. The child is restrained in an open rectangular shaped cradle which is pivotally mounted for rotation in a floatable body. Pointed screws engage spindles to lock the cradle to the floatable body with the child in an upright position. The inclination of the child is adjusted in increments from an upright position toward a horizontal position to permit the child to practice the arm and leg movements of a swimmer. The floatable body is comprised of a cellular plastic body and a reinforcement attached to an upper surface of the body. In an alternate embodiment, the floatable body is comprised of a thin planar center member and front and rear floatable members. Outriggers and keels increase the overturning resistance of the device. Extensible hand cranks increase the effectiveness of the training device.

24 Claims, 6 Drawing Sheets

SWIMMER'S TRAINING DEVICE

BACKGROUND OF THE INVENTION

Swimming is an increasingly popular recreational activity. The popularity has been enhanced by a significant increase in the number of private and public swimming pools, lakefront homes, river front homes and ponds. Training can be safely started as soon as a child has developed sufficient muscle control to maintain an erect head posture. Many infants and toddlers are taught to swim between one and three years of age.

Although many simple flotation devices are available, a great need exists for an improved and effective training device which maximizes safety and progressively teaches proper swimming techniques. A child should always be attended, therefore, for a child's pleasure and security the training device should be manually controlled for close monitoring by an attendant. The training device should also prevent a child from immersing his/her head, in the event the child is negligently left unattended.

SUMMARY OF THE INVENTION

It is a primary object of the present invention to provide an effective swimmer's training device for children which provides maximum safety under all conditions. It is another object, in addition to the foregoing object, to develop proper swimming techniques and reduce the time for training a child. It is another object, in addition to the foregoing objects, to provide a training device which is fun to use.

With the foregoing objects in mind, the present invention is a highly effective device which prevents a child from actively immersing his head in water. The training device comprises a floatable body, a cradle pivotally connected to the floatable body, and a restraint system attached to the cradle. A bumper is provided to prevent injury if the child should fall forward and impact the floatable body. When the child is in a free position, the child is essentially upright with his head out of water. The floatable body has a high resistance to overturning. In a second aspect of the invention, outriggers and keels are provided for increasing the trainer's resistence to overturning.

In employing the teachings of the present invention, a plurality of alternate constructions can be adopted to achieve the desired results and capabilities of the invention. In this disclosure, only several aspects of the invention are illustrated and discussed. However, these aspects are intended as examples and should not be considered as limiting the scope of the invention.

Further objects, benefits and features of the invention will become apparent from the ensuing detailed description and drawings of the invention. The best mode which is contemplated in practicing the invention together with the manner of using the invention are disclosed and the property in which exclusive rights are claimed is set forth in each of a series of numbered claims at the conclusion of the detailed description.

DETAILED DESCRIPTION OF A PREFERRED EMBODIMENT

Figure 1:
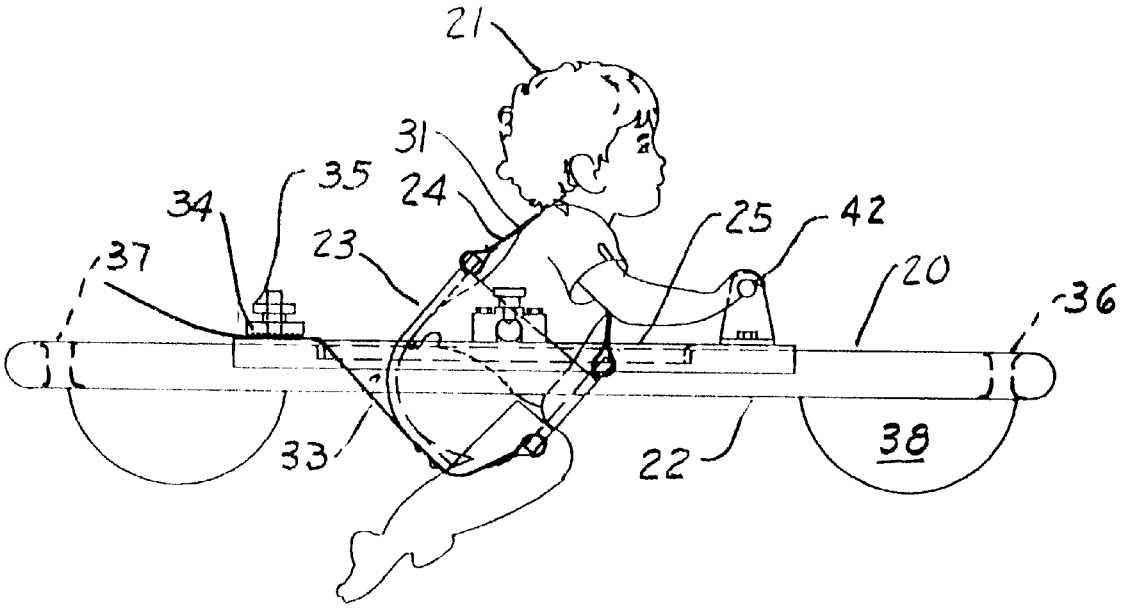
FIG. 1 is a right side view of a child and swimming training device according to the present invention.
Figure 2:
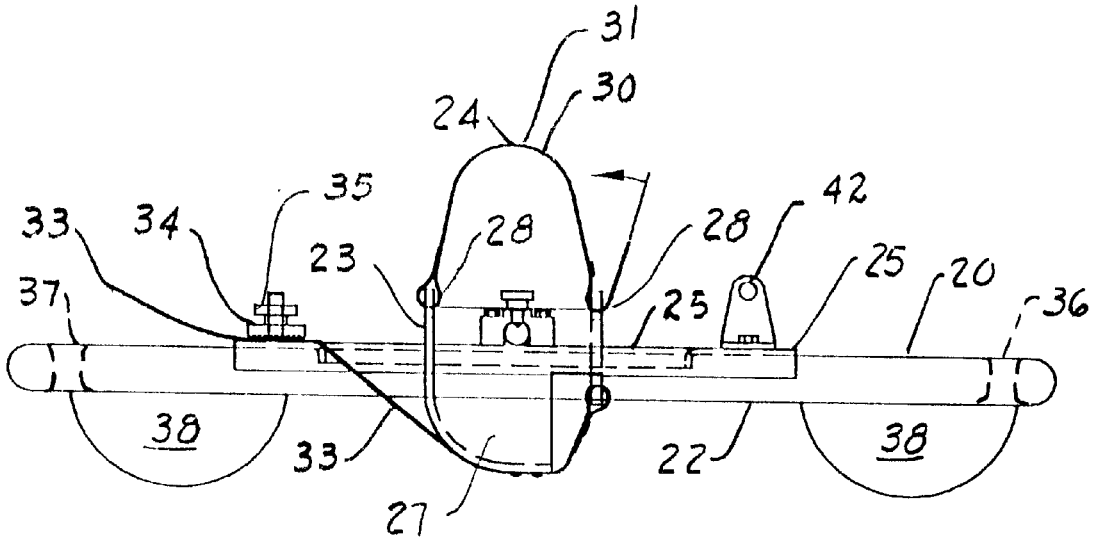
FIG. 2 is the right side view of the training device without the child.
Figure 3:
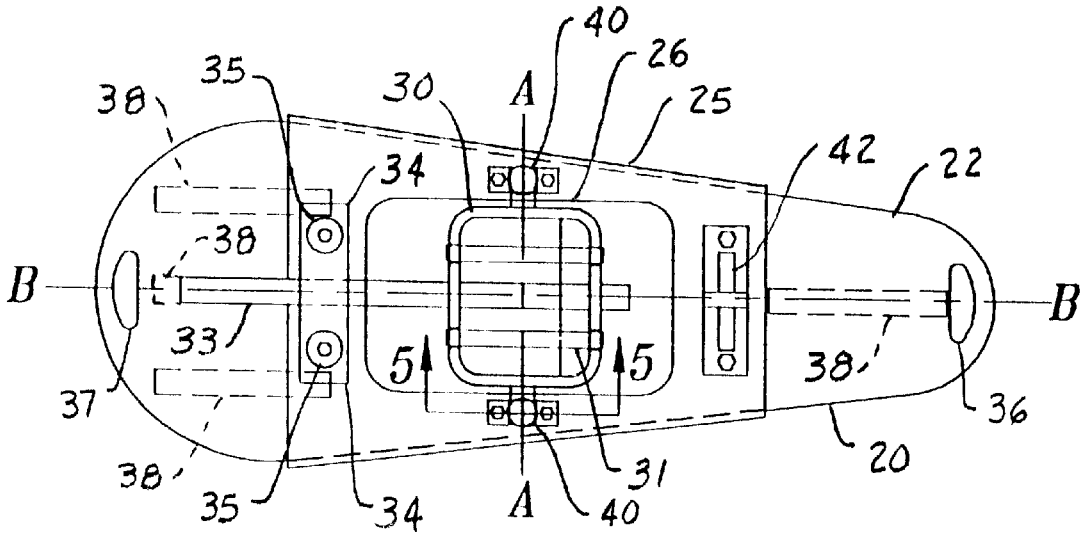
FIG. 3 is a plan view of the training device.

Referring now to the drawings wherein like numerals designate like and corresponding parts throughout the several views, a swimmer's training device 20 and child 21 are shown in FIGS. 1 through 4, inclusive, according to the present invention. The training device 20 is intended to be used with young children, even infants of ages one through three, but is suitable for toddlers and older persons as well.

The training device 20 is broadly comprised of a planar body 22, a pivotal cradle 23 attached to the planar body 22 for rotation about a horizontal axis A—A, and a restraint system 24 attached to the cradle 23. The horizontal axis A—A is in perpendicular relationship to a longitudinal axis B—B of the planar body 22.

The planar body 22 is preferably made of a floatable cellular polymer, such as polystyrene, but may also be a hollow blow molded or vacuum formed polymer made with well known forming methods. Bonded to the upper surface of a center portion of the body 22 is a thin plastic reinforcement 25 for attaching the cradle 23 and other members to the body 22.

Extending through the center of the body 22 and reinforcement 25 is a rectangular aperture 26 for receiving the cradle 23. The cradle 23 is an open rectangular shaped member with thin outer walls 51 and a seat portion 27. In front and rear portions of the cradle 23 are slotted apertures 28 for attaching the restraint system 24. The size of the rectangular aperture 26 prevents the child 21 from immersing its head in water. Extending outwardly from the sides of the cradle 23 are short cylindrical spindles 29 for rotatably mounting the cradle 23 to the floatable body 22.

The child 21 can be restrained in the cradle a number of known ways. By way of example, the child 21 can be restrained in a sleeveless garment such as a suit or vest (not shown) which is attached to the cradle 23. A preferable way is depicted in the drawings which are exemplary of the invention. The restraint system 24 is comprised of a four point type harness with vertical 31 and horizontal 32 straps for restraining the shoulders and torso of the child 21 and a lower longitudinal strap 33 for restraining the lower portion of the child 21. The lengths of the straps 31, 32, 33 are adjustable to accommodate variations in the size of the child 21. A rear portion of the lower strap 33 is clamped to the cradle 23 with a clamping bar 34 and a pair of thumb nuts 35. The clamping bar 34 is also used for changing the inclination of the child 21 in the training device 20.

Figure 5:
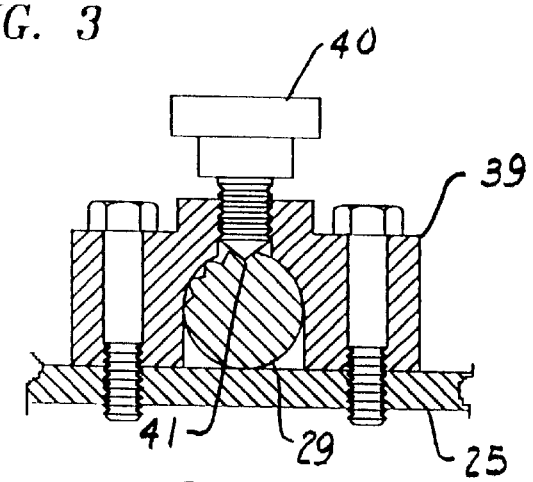
FIG. 5 is an enlarged cross-sectional view taken on the line 5—5 in FIG. 3.

In front and rear portions of the floatable body 22 are apertures 36,37 for the hands of an attendant (not shown). On the bottom of the floatable body 22, three longitudinal keels 38 extend downwardly to resist overturning of the body 22. Referring to FIG. 5, the cradle 23 is pivotally mounted to the reinforcement 25 with a pair of caps 39. In each of the caps 39 is a pointed thumb screw 40. The thumb screw 40 engages a notch 41 of the spindle 29 to lock the child 21 in an upright position. The spindles 29 are preferably located above the center of gravity of the child 21 to bias the child 21 in an upright position if the cradle 23 is unlocked and the child 21 is unattended. On a forward portion of the cradle is a "T" handle 42 for the child 21 to grasp.

The invention is intended to be used as follows. With the training device 20 floating in a body of water, the child 21 is lowered on to the cradle's seat 27 and the lower strap 33 is passed between its legs, in a similar manner to positioning a child in a car seat. A rear portion of the lower strap 33 is passed under the clamping bar 34 and the thumb screws 40 are tightened to restrain the child 21 in an upright position. The upper straps 31, 32 are passed over the child's shoulders and are passed through the apertures 28 and attached to the cradle 23. During the attachment of the straps 31, 32, they are adjusted to restrain the child 21 snugly and comfortably in the cradle 23.

After the child 21 has been restrained, its fear of water, if any, is overcome by moving the cradle 23 in the water. With the cradle 23 locked, the cradle 23 is grasped and rocked and/or towed through the water. While the cradle 23 is towed, the child 21 is encouraged to kick its feet to familiarize the child 21 with the use of its feet during swimming.

When the child 21 demonstrates that it is not afraid of water, the cradle 23 is unlocked and the child 21 is slightly inclined by re-positioning the end of the lower strap 33 under the clamping bar 34. In the inclined position, the child 21 is instructed to grasp the T-handle 42 with its hands to steady itself and to kick its feet while it is towed through the water. The inclination is increased in steps. After the child 21 has acquired experience in kicking its feet while holding the T-handle 42, it is instructed to release the T-handle 42 and to paddle its arms. As a final step, the child 21 is instructed to simultaneously paddle its arms and kick its feet at various torso angles.

Figure 4:
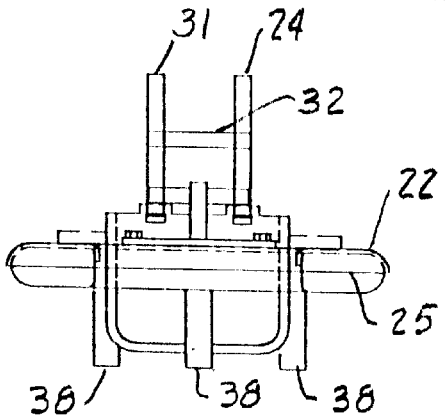
FIG. 4 is a front view of the training device.
Figure 6:
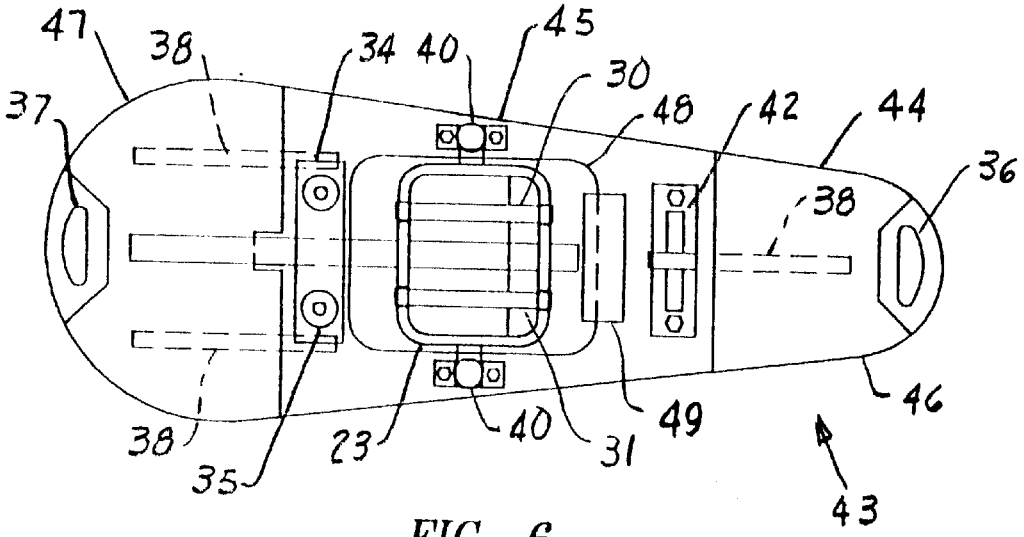
FIG. 6 is a plan view of an alternate embodiment of the training device.
Figure 7:
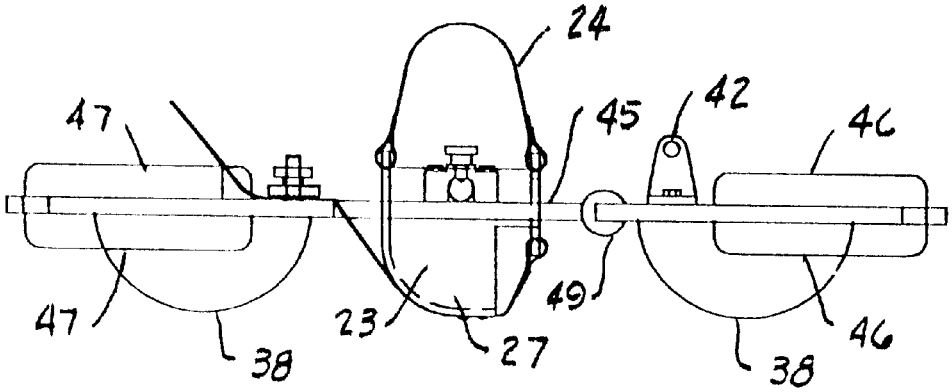
FIG. 7 is a right side view of the alternate embodiment.
Figure 8:
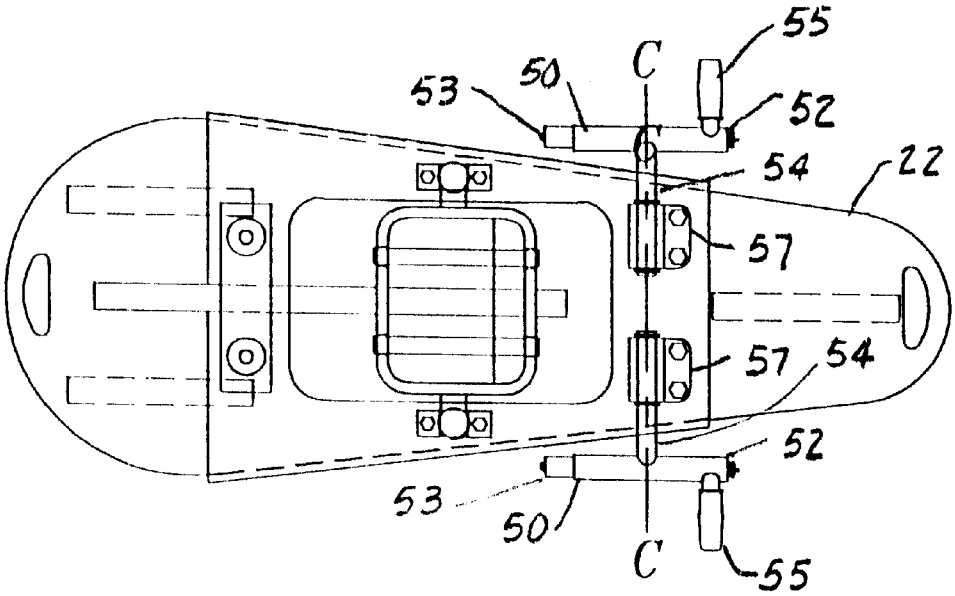
FIG. 8 is a plan view of a second alternate embodiment.

In FIGS. 4 through 6, inclusive is an alternate embodiment 43 wherein a floatable body 44 consists of a thin planar center member 45 and front 46 and rear 47 cellular members which are adhesively or mold bonded to upper and lower surfaces of the planar member 45. At a forward edge of a rectangular aperture 48 is a deformable bumper 49 for preventing injury if the child 21 should strike the planar member 45.

Figure 9:
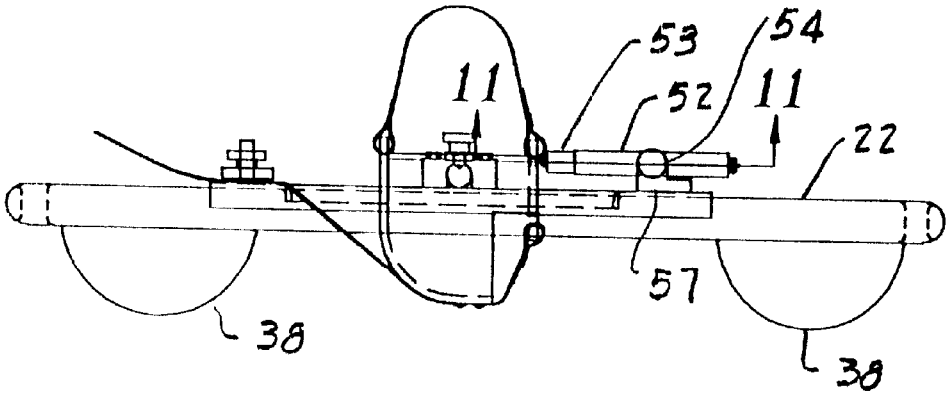
FIG. 9 is a right side view of the second alternate embodiment.
Figure 10:
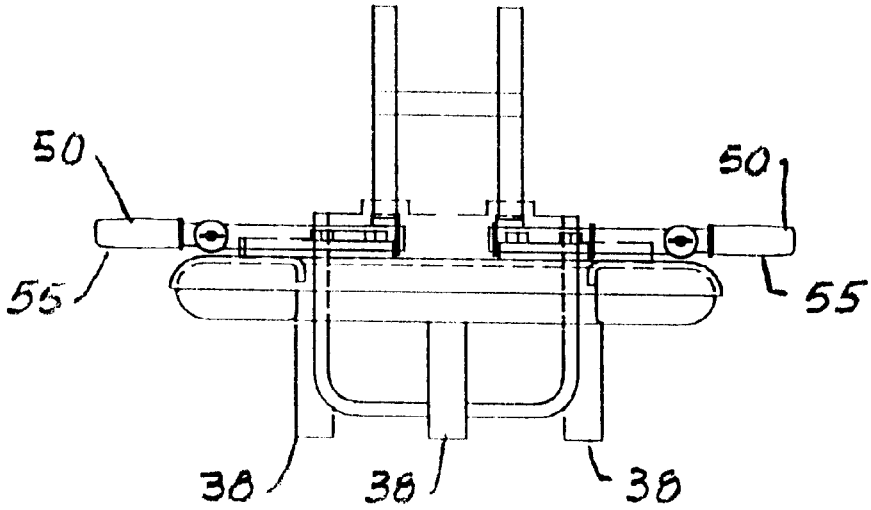
FIG. 10 is a front view of the second alternate embodiment.
Figure 11:
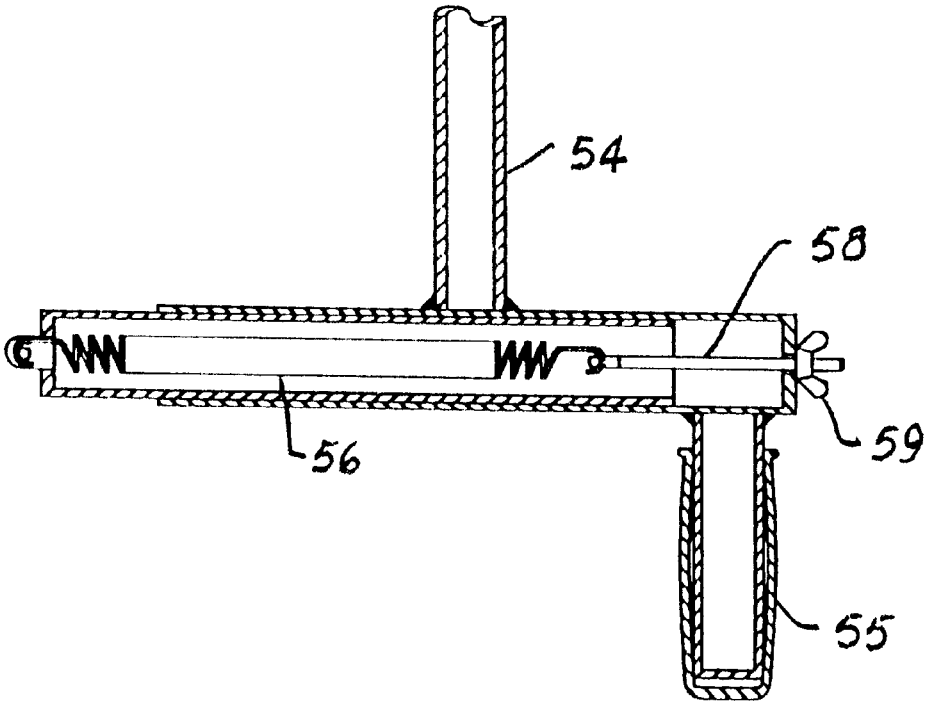
FIG. 11 is an enlarged cross-sectional view taken on the line 11—11 in FIG. 9.

In FIGS. 9 through 11, a pair of extensible hand cranks 50 are substituted for the T-handle 42. The extensible hand cranks 50 are used to strengthen the child's arms and to train the child 21 in the proper use of its arms. Referring to FIG. 11, each of the hand cranks 50 has a pair of telescoping tubular members 52, 53, a spindle 54 attached to one of the members 52, a handle 55 attached to the other of the members 53, and an extension spring 56 inside of the tubular members 52, 53. The spindles 54 are independently attached to the reinforcement 25 with caps 57. The extension spring 56 which is located inside of the tubular members 52, 53 has one end portion attached to one of the tubular members 52 and an opposite end portion attached to a wire hook 58. A threaded end portion of the wire hook 58 extends through one of the tubular members 52, 53 and engages a wing nut 59. A pre-tension of the spring 56 is adjusted by rotating the wing nut 59 to enable the child 21 to extend its arms as it rotates the hand cranks 50. During each rotation of the hand cranks 50, the arms extend forwardly and downwardly in a similar manner as a swimmer.

Figure 12:
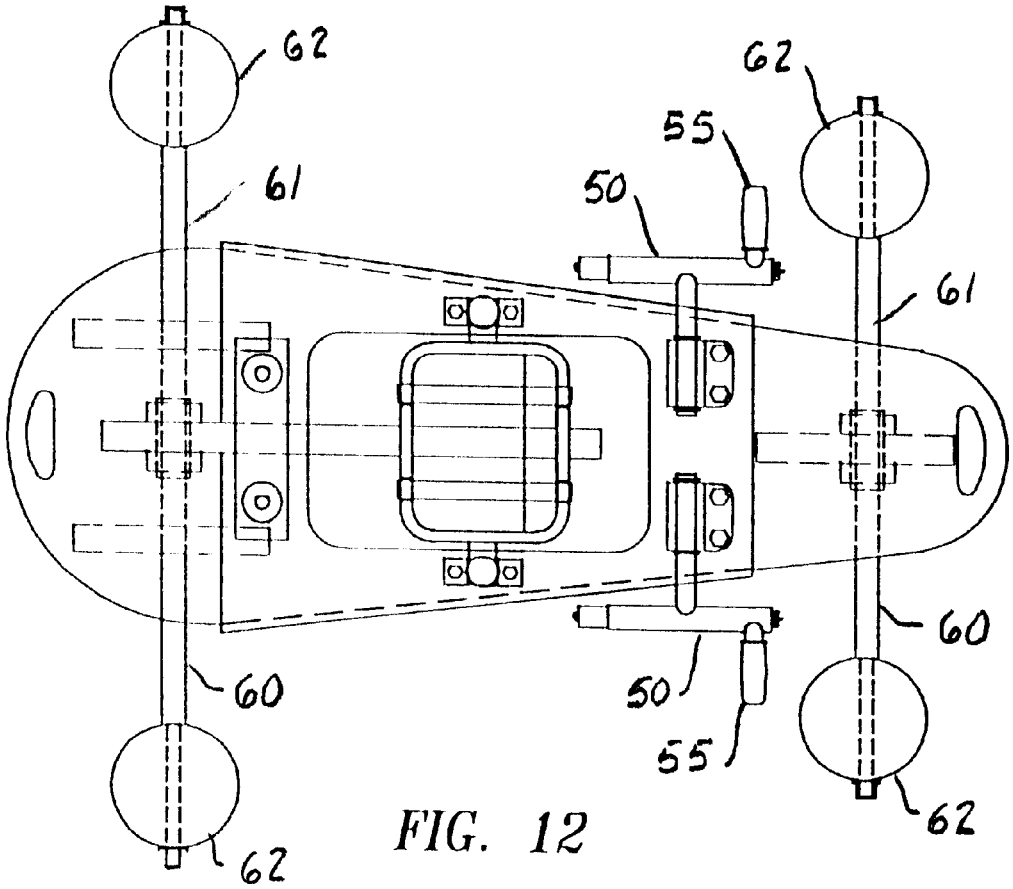
FIG. 12 is a plan view of a third alternate embodiment.
Figure 13:
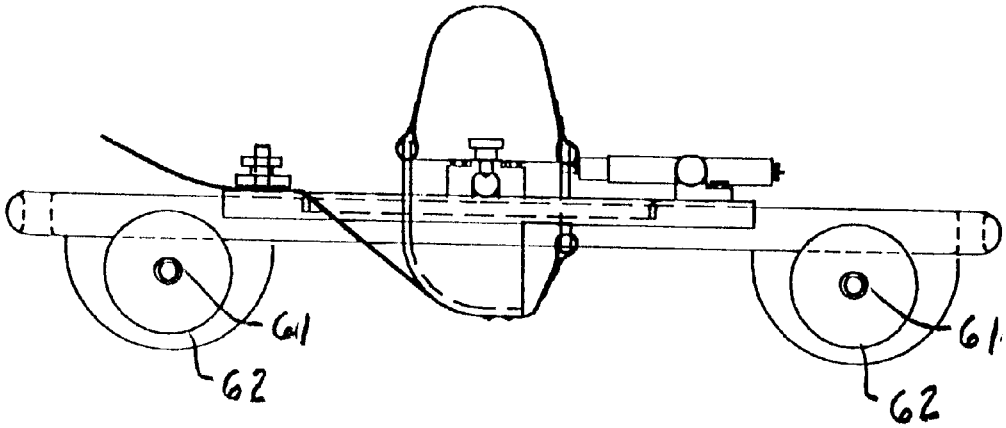
FIG. 13 is a right side view of the third alternate embodiment.
Figure 14:
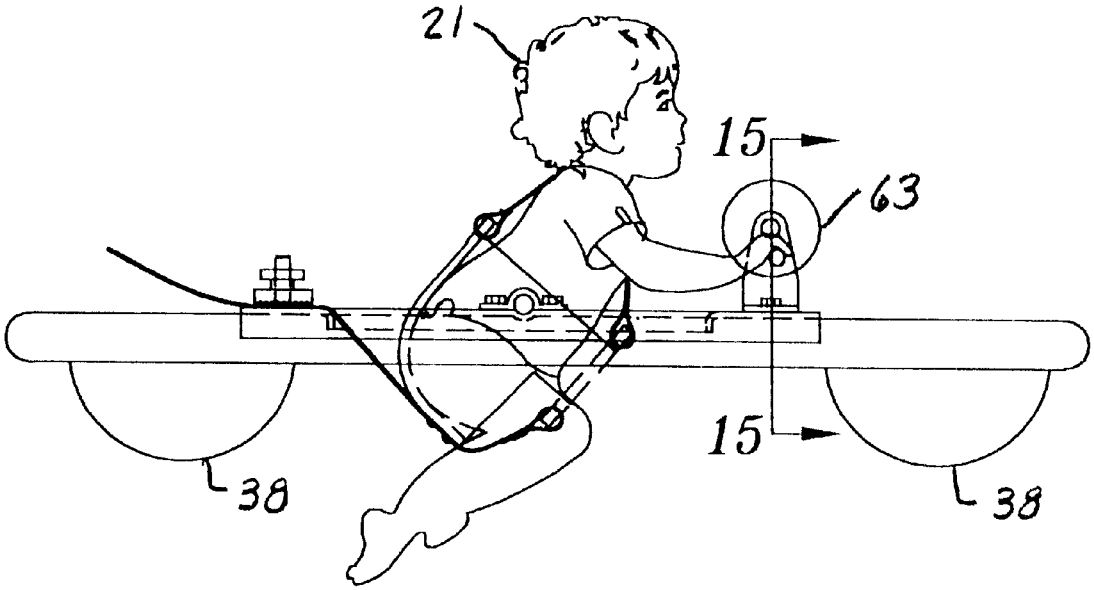
FIG. 14 is a right side view of a fourth alternate embodiment.
Figure 15:
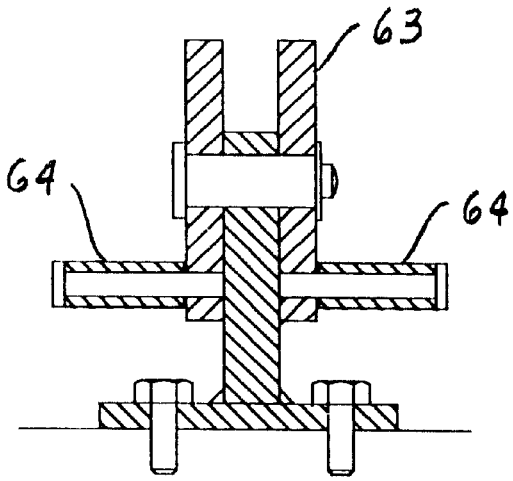
FIG. 15 is an enlarged cross-sectional view taken on the line 15—15 in FIG. 14.

In FIGS. 12 and 13, a pair of lateral outriggers 60 have been added to keels 38 of the swimmer's trainer 20 to increase its roll-over resistance. Each of the outriggers 60 is comprised of a shaft 61 and a pair of cellular ABS floats 62 mounted on the end of the shaft 61. In FIGS. 14 and 15, a rotatable wheel 63 with handles 64 is provided in place of the pair of the hand cranks 50.

From the foregoing it will be understood that our invention provides an effective training device and method for training a child how to swim. Although it is not recommended that a child be unattended, our swimmer's training device increases the safety of unattended children. Although only several embodiments have been described, it will be appreciated that other embodiments can be derived by such changes as shapes and materials, substitution of parts, variations in the numbers and arrangement of parts and changes in method steps without departing from the spirit thereof.

What we claim as new is:

1. A swimmer's training device for training children how to swim comprising: a floatable body, said body having an opening in a center portion of said body; a cradle pivotally mounted for rotation in said opening for selectively rotating a child in increments from a substantially vertical position to a forward inclined position; and a restraint system attached to said cradle for restraining said child in said cradle.

2. The swimmer's training device recited in claim 1 further comprising a means for fixing a child in said substantially vertical position.

3. The swimmer's training device recited in claim 1 further comprising a T-handle mounted on a forward portion of said body.

4. The swimmer's training device recited in claim 1 further comprising a pair of pivotally mounted extensible arms mounted on said body for rotation about a horizontal axis, each of said extensible arms having a handle in lateral outward extending relationship to said arm.

5. The swimmer's training device recited in claim 1 further comprising at least one downward extending keel for increasing an overturning resistance of said training device.

6. The swimmer's training device recited in claim 1 further comprising at least one outrigger in lateral relationship to a longitudinal axis of said body to increase a resistance of said training device to overturning.

7. The swimmer's training device recited in claim 1 wherein said cradle has a seat portion for supporting a child.

8. The swimmer's training device recited in claim 1 wherein said restraint system is comprised of a pair of a pair of belts for restraining a pair of shoulders and a torso of a child and a lower belt for restraining a pair of legs of said child.

9. The swimmer's training device recited in claim 1 wherein said floatable body is a cellular plastic floatable body.

10. The swimmer's training device recited in claim 1 further comprising a thin reinforcement bonded to an upper portion of said body.

11. The swimmer's training device recited in claim 1 wherein said floatable body is comprised of a planar center member and cellular plastic members bonded to front and rear portions of said planar center member.

12. The swimmer's training device recited in claim 1 further comprising a means for selectively fixing a child in an inclined portion in said training device.

13. The swimmer's training device recited in claim 1 further comprising apertures at front and rear portions of said floatable body for receiving a pair of hands of an attendant.

14. The swimmer's training device recited in claim 4 wherein each of said pivotally mounted extensible arms is comprised of: a pair of telescopically engaging tubular members; one of said handles in lateral outward extending relationship to one of said tubular members; and a spring for pulling said tubular members toward each other.

15. The swimmer's training device recited in claim 14 further comprising a means for increasing said pulling of said tubular members toward each other.

16. A swimmer's training device for training children how to swim comprising: a cellular floatable body, said body having an opening in a center portion of said body; a reinforcement attached to an upper portion of said cellular body; a cradle pivotally mounted for rotation in said opening for rotating a child from a substantially vertical position to a forward inclined position; a means for fixing said child in a substantially vertical or inclined position in said training device; and a restraint system attached to said cradle for restraining said child in said cradle.

17. A method for training a child how to swim comprising the steps of: restraining said child in a cradle of a floatable training device in water which is pivotally mounted for rotation about a horizontal axis, in lateral relationship to a longitudinal axis of said training device; fixing said child in a substantially vertical position in said training device; releasing said child from said vertical position; selectively tilting said child forward in increments in said training device.

18. The method for training a child how to swim recited in claim 17 further comprising the step of said child kicking its legs in said water.

19. The method for training a child how to swim recited in claim 17 further comprising the step of said child grasping a T-handle mounted in a front portion of said training device.

20. The method for training a child how to swim recited in claim 17 further comprising the steps of said child grasping, rotating and extending a pair of extensible arms mounted on a forward portion of said training device.

21. The method for training a child how to swim recited in claim 20 further comprising the step of selectively increasing a resistance of said arms to extending.

22. The method for training a child how to swim recited in claim 17 further comprising the step of having said child grasp and rotate a wheel mounted for rotation about a horizontal axis on a forward portion of said training device.

23. The method for training a child how to swim recited in claim 17 further comprising the steps of releasing said child from said substantially horizontal position; and selectively tilting said child in increments forward from said vertical position.

24. The method for training a child how to swim recited in claim 17 further comprising the step of selectively increasing the forward tilt of said child.

* * * * *